US010052541B2

(12) United States Patent
Johnson et al.

(10) Patent No.: US 10,052,541 B2
(45) Date of Patent: Aug. 21, 2018

(54) STRIKING TARGET APPARATUS FOR MARTIAL ARTS TRAINING

(71) Applicants: David Johnson, Rockville Centre, NY (US); Gianni Peragine, Baldwin, NY (US)

(72) Inventors: David Johnson, Rockville Centre, NY (US); Gianni Peragine, Baldwin, NY (US)

( * ) Notice: Subject to any disclaimer, the term of this patent is extended or adjusted under 35 U.S.C. 154(b) by 9 days.

(21) Appl. No.: 15/042,961

(22) Filed: Feb. 12, 2016

(65) Prior Publication Data

US 2016/0236054 A1 Aug. 18, 2016

Related U.S. Application Data

(60) Provisional application No. 62/116,529, filed on Feb. 15, 2015.

(51) Int. Cl.

| | |
|---|---|
| ***A63B 69/32*** | (2006.01) |
| ***A63B 69/34*** | (2006.01) |
| ***A63B 69/00*** | (2006.01) |
| *A63B 71/02* | (2006.01) |
| *A63B 71/00* | (2006.01) |
| *A63B 71/06* | (2006.01) |

(52) U.S. Cl.

CPC ..... *A63B 69/004* (2013.01); *A63B 71/023* (2013.01); *A63B 2071/0063* (2013.01); *A63B 2071/0625* (2013.01); *A63B 2071/0694* (2013.01); *A63B 2210/50* (2013.01)

(58) Field of Classification Search

CPC ..... A63B 69/004; A63B 2069/0042; A63B 69/20; A63B 69/208; A63B 69/24; A63B 69/325; A63B 69/34

See application file for complete search history.

(56) References Cited

U.S. PATENT DOCUMENTS

| | | | | |
|---|---|---|---|---|
| 4,662,630 A * | 5/1987 | Dignard | A63B 69/004 482/83 |
| 4,742,633 A | 5/1988 | Snediker | |
| 4,817,941 A | 4/1989 | McCorry | |
| 4,837,957 A * | 6/1989 | Egender | G09F 11/00 40/488 |
| 5,005,512 A * | 4/1991 | Fu | E04H 12/182 116/173 |
| 5,254,062 A | 10/1993 | Hoffman | |
| 5,464,108 A * | 11/1995 | Samelson | A45C 3/00 150/118 |
| 5,472,395 A * | 12/1995 | Trocchio | A63B 69/004 482/83 |

(Continued)

OTHER PUBLICATIONS

Sakura Martial Arts Supplies. Training Target Target-X Trainer, Jan. 6, 2015. Website: <https://web.archive.org/web/20150106121133/http://www.sakuramartialarts.com/Martial_Arts_Equipment-_Training_Target_p/equ-8297-a1.htm>.

(Continued)

*Primary Examiner* — Nyca T Nguyen

(74) *Attorney, Agent, or Firm* — Carter, DeLuca, Farrell & Schmidt, LLP

(57) ABSTRACT

A striking target apparatus provides audible satisfaction feedback to the user when struck, and provides substantial focus training with minimal impact. The apparatus may be hand-held, mounted onto a wall or other smooth surface, or attached to a stand.

18 Claims, 14 Drawing Sheets

(56) References Cited

U.S. PATENT DOCUMENTS

| | | | | | |
|---|---|---|---|---|---|
| 5,476,433 | A * | 12/1995 | Bruner | A63B 69/004 | 482/83 |
| 6,033,348 | A * | 3/2000 | Warshauer | A63B 69/004 | 482/83 |
| 6,258,013 | B1 * | 7/2001 | Dabney | A63B 24/0021 | 482/83 |
| 7,591,768 | B1 | 9/2009 | Geeting | | |
| 7,942,791 | B1 * | 5/2011 | Yocum | A63B 69/004 | 482/35 |
| 8,029,422 | B2 | 10/2011 | Strong et al. | | |
| D742,983 | S * | 11/2015 | Siciliano | D21/787 | |
| 2008/0023355 | A1 * | 1/2008 | Reynolds | A63B 71/0036 | 206/315.1 |
| 2012/0108352 | A1 * | 5/2012 | Goldstein | A43B 3/0078 | 473/218 |
| 2014/0104057 | A1 * | 4/2014 | Futrell | B60Q 7/00 | 340/473 |
| 2015/0057131 | A1 * | 2/2015 | Manley | A63B 69/004 | 482/83 |

OTHER PUBLICATIONS

Written Opinion of the International Searching Authority dated Apr. 29, 2016 for PCT/US2016/017954.

* cited by examiner

STRIKING TARGET APPARATUS FOR MARTIAL ARTS TRAINING

CROSS-REFERENCE TO RELATED APPLICATIONS

This application claims the benefit of and priority to U.S. Provisional Application Ser. No. 62/116,529, filed on Feb. 15, 2015, the entire contents of which are incorporated by reference herein.

BACKGROUND

The term "martial arts" embraces karate, boxing, Taekwondo, Kempo, Muay Thai Kickboxing, MMA, and other disciplines from a variety of backgrounds. Kicking, punching, blocking and/or striking are basic skills common to many, if not all of the martial arts. Students of the martial arts develop such skills through training that typically entails either body to body contact, or body to target contact.

Currently targets used for martial arts training place physical stress on the student's body. Padded, bulky targets lessen impact, but still pose a risk of impact injury to the student. Training effectiveness can be hindered by a tentative student, and poor habits can develop. Additionally, oversized, hard targets require a significant amount of space to store, and can be difficult to move and secure in place for proper training.

In traditional martial arts training, an instructor may hold a piece of X-Ray film in place for a student to kick or punch. Frequently, this training technique results in injury to the instructor (e.g., when a student misses the film, but hits the instructor). Also, the release of potentially harmful chemicals from the X-Ray film itself may pose the threat of long term consequences for the trainer and/or the student from repeated use.

Accordingly, a need exists for a striking target useful in martial arts training that is compact in size, easy to use, and protects both the trainer and the student from injury.

SUMMARY

The present disclosure provides for striking target apparatus, for example, hand-held padded flags that provide all the benefits of a pliable, minimal-impacting target, which builds user confidence by positive sound reinforcement and zero physical stress, while posing no threat of injury to the holder or the striker.

In one aspect of the present disclosure, a striking target apparatus is provided and includes a handle assembly and a striking portion. The handle assembly includes an inner tube and an outer cushion configured to be disposed about the inner tube. The inner tube and outer cushion each define a longitudinally-extending slit therein. In embodiments, the outer cushion is fabricated from a softer material than the inner tube. The striking portion is configured to be secured in the slits of the inner tube and outer cushion such that movement of the striking portion relative to the handle assembly is inhibited. The striking portion is fabricated from a material configured to emit a sound having a volume commensurate with an amount of force being applied to the striking portion.

In embodiments, the material of the striking portion may be plastic, for example, polyester.

In embodiments, the striking portion may further include a fastener attached to a lateral side of the striking portion. The fastener may have a width greater than a width of the slit of the inner tube such that the fastener inhibits lateral movement of the striking portion out of the slit of the inner tube.

In embodiments, the apparatus of the present disclosure are light, quick, and can be used as both a striking target and a blocking device.

In embodiments, a single target can be joined together with additional targets in order to accommodate multiple strikes or multiple users simultaneously.

In embodiments, the apparatus may include a flat surface that is easily cleaned.

In embodiments, the slim, light target may be well-suited for easy storage.

In embodiments, multiple targets can be transported effortlessly, making them ideal for travel to martial arts competitions, where they would serve as ideal "warm-up" tools for competitors.

In embodiments, the durability of the design and materials allows for repeated use.

In embodiments, the apparatus may require minimal storage needs, making it an ideal tool to help students practice lessons at home.

In embodiments, the striking target apparatus may be devoid of metal parts while holding up well in all climates. In addition, assembly is quick and easy.

BRIEF DESCRIPTION OF THE FIGURES

Embodiments of the present disclosure are described herein with reference to the accompanying drawings, wherein.

DETAILED DESCRIPTION

Flag Striking Material

Figure 1:
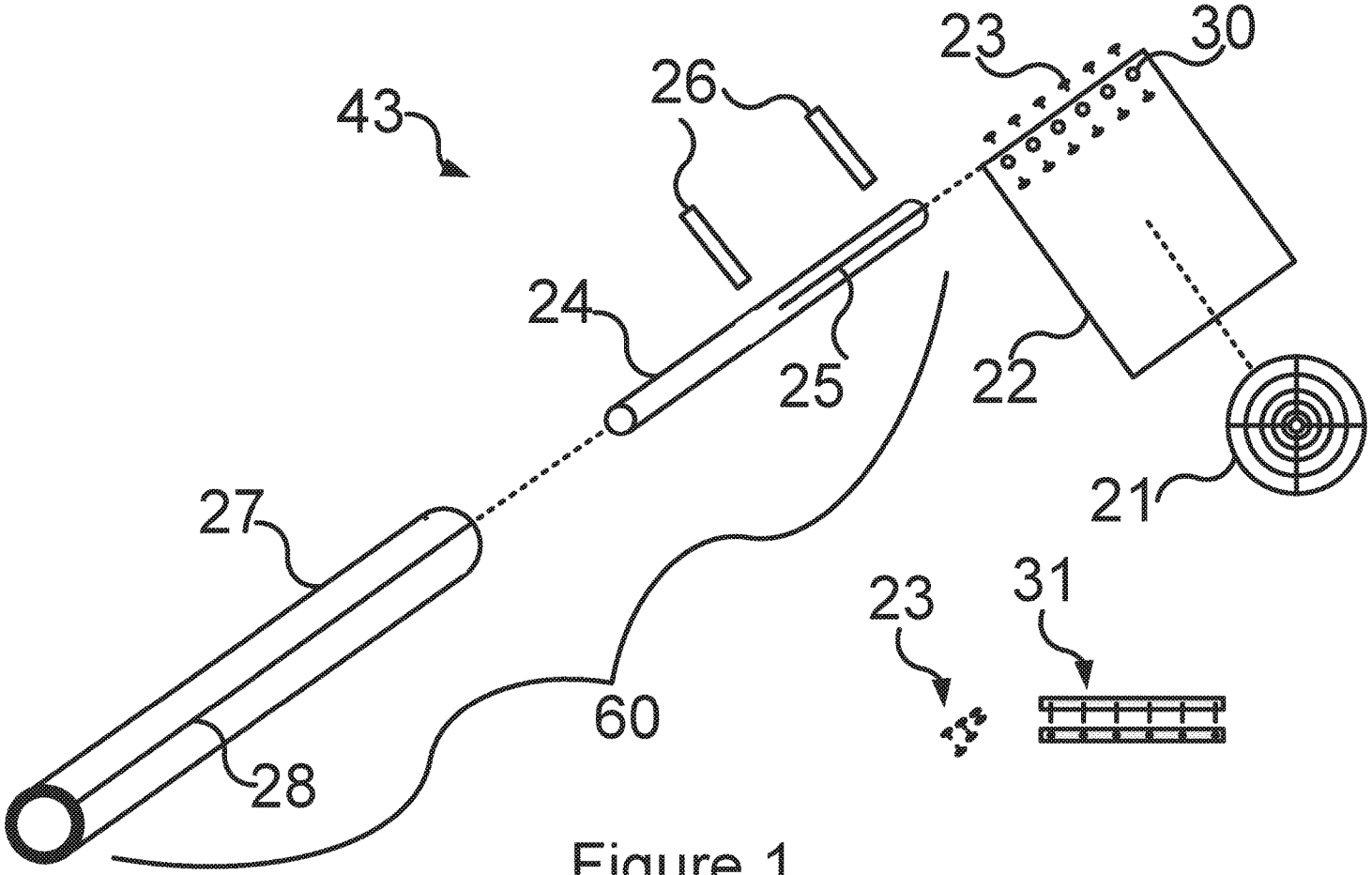
FIG. 1 is an exploded view of a striking target apparatus in accordance with an embodiment of the present disclosure including a handle assembly and a striking portion or flag.

Particular embodiments of the present disclosure are described hereinbelow with reference to the accompanying drawings. However, it is to be understood that the disclosed embodiments are merely exemplary. Therefore, specific structural and functional details described herein are not to be interpreted as limiting, but merely as a basis for the claims and as a representative basis for teaching one skilled in the art to variously employ the presently disclosed concepts in virtually any appropriately detailed structure.

Like reference numerals may refer to similar or identical elements throughout the description of the figures. As shown in the drawings and described throughout the following description, the term "proximal" refers to the end of the apparatus which is closer to the person holding the device and the term "distal" refers to the end of the apparatus which is farther away from the person holding the device.

The word "exemplary" is used herein to mean "serving as an example, instance, or illustration." Any embodiment described herein as "exemplary" is not necessarily to be construed as preferred or advantageous over other embodiments. The word "example" may be used interchangeably with the term "exemplary."

With reference to FIGS. 1-5*d*, a striking target, for example, striking target apparatus 43 includes a handle assembly 60 and a striking portion, for example, a flag striking material 22, coupled to the handle assembly 60. Flag striking material 22 serves as the focal point for striking. Flag striking material 22 may be made from any material that produces an audible sound when struck by a user. Suitable materials include, but are not limited to various plastics, paper, or other flexible yet stiff material in nature capable of producing an audible sound (sometimes referred to as a feedback sound) when struck. Flag striking material 22 may be made of an opaque, transparent or translucent film material. The material, size, and thickness are determined by the desired reaction when struck, shaken, or waved. In embodiments, flag striking material 22 may be fabricated from plastic, such as for example, nylon, vinyl, or polyester, such as polyethylene terephthalate. One suitable material from which striking material 22 may be made is SKYROL™ SR53. Flag striking material 22 may be any size suitable to serve as a target for practicing striking movements. In embodiments, flag striking material 22 may be a sheet having a width of from about 6 inches to about 18 inches (in embodiments, about 10 inches), a length of from about 6 inches to about 18 inches (in embodiments, about 12 inches), and a thickness of from about 5 mm to about 20 mm (in embodiments, about 14 mm). A SKYROL™ SR53 sheet of these dimensions has been found to be durable and to produce the desired effect of a significant "thwack" sound as an audible confirmation of a proper strike.

The type of material for flag striking material 22 depends on the type of effect desired. SKYROL™ SR53 plastic yields a sufficiently loud and satisfying acknowledgement of the striking force favored, especially by children, with minimal impact to the striking object. This significantly reduces the risk of injury, stress, and/or pain on the user during training. Additionally, flag striking material 22 serves as a focal point for striking while providing positive feedback in the form of both sound and motion.

Flag striking material 22 has several pre-punched holes 30 along flat lateral edge 22*a*, with the corners 22*c* of the opposite, exposed edge 22*b* being rounded to further reduce risk of injury. The number of holes 30 will be dependent on the material used, strength, and style of restraint employed.

Sticker/Label/Print & Focus Area

Figure 2:
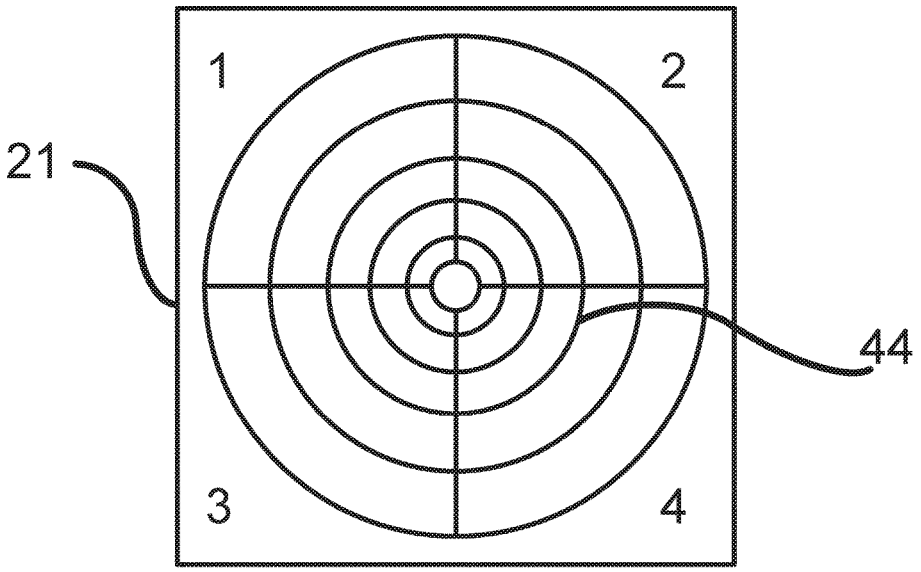
FIG. 2 is a plan view of an exemplary indicia that can be applied to the striking portion of FIG. 1 for the purpose of providing focus and division of the target into regions.

With reference to FIG. 2, striking target apparatus 43 includes indicia 21 applied to flag striking material 22. Indicia 21, which in addition to artwork or a logo, may include a bull's-eye like outline to provide the additional benefit of driving the user's focus to a specific point approximately (and intentionally) the size of a fist, head, or heart, for example. Indicia 21 can be applied as a sticker or label, or may be printed directly on flag striking material 22. Indicia 21 may divide flag striking material 22 into distinct areas to provide various locations of focal points. As shown in the exemplary embodiment of FIG. 2, for example, indicia 21 divides flag striking material 22 into four quadrants using cross hairs, and provides a bull's-eye 44 in approximately the center of flag striking material 22. Each area can be indicated by number or color and allows the instructor (in person, via audio/video device, or via written instruction) to indicate which particular area of the flag striking material 22 the student should target (strike) as part of drills, games, or training programs in which the various areas are struck in any desired pattern and pace to accomplish specific goals or sequences. These sequences can be practiced to achieve the ability to repeat the sequences in speed and accuracy and/or for competition.

Tube

Figure 3:
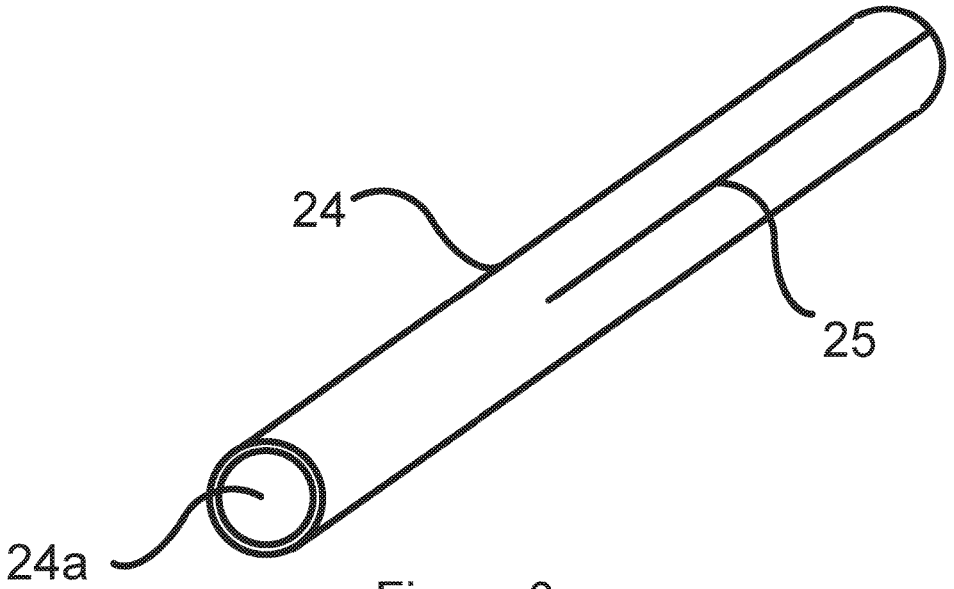
FIG. 3 is a perspective view of the inner tube of the handle assembly of FIG. 1 showing the slot therein configured for insertion of the striking portion.
Figure 7A:
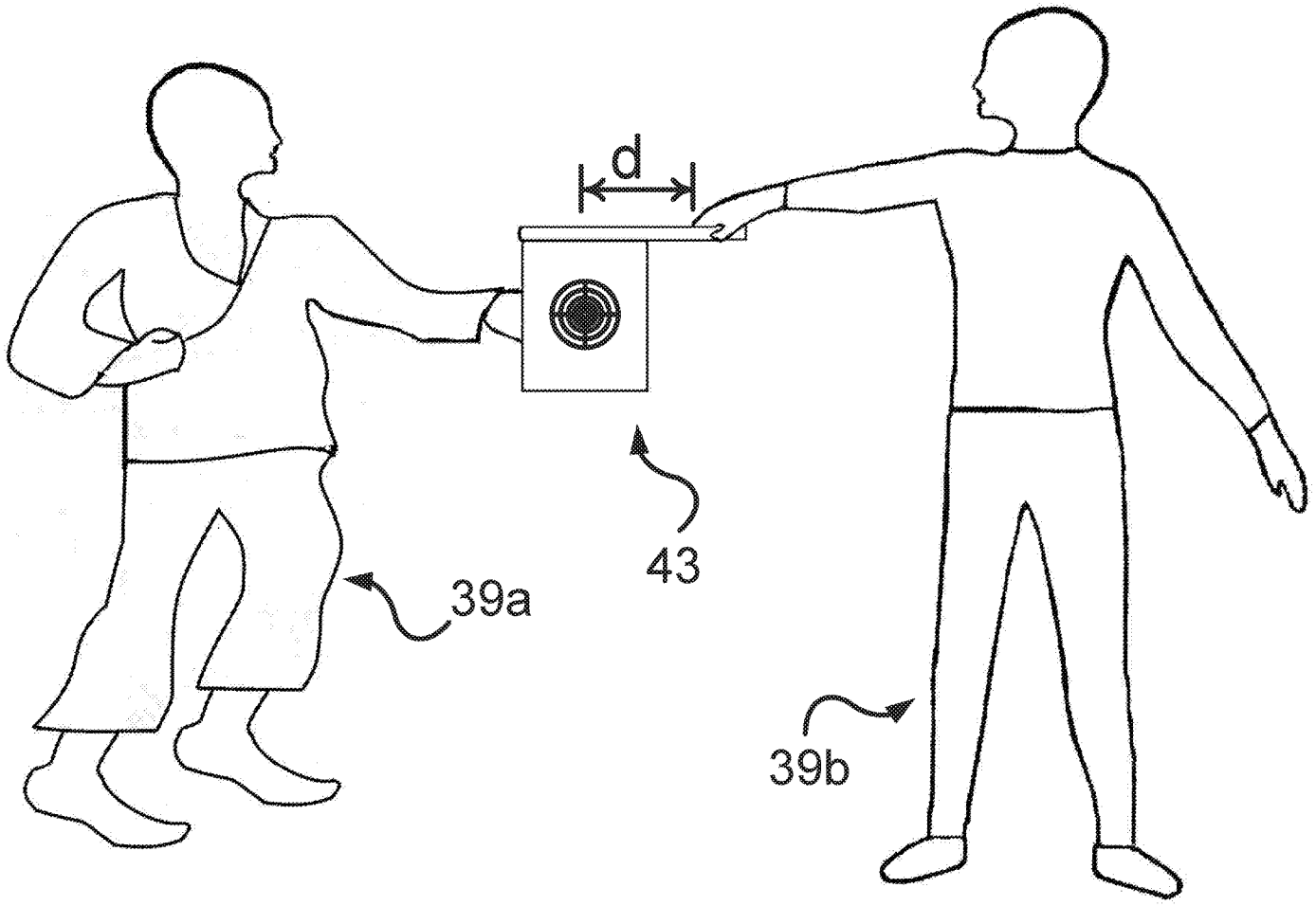
FIG. 7*a* is an illustration of an exemplary use of the striking target apparatus of FIG. 1 with a user striking the flag with a fist.
Figure 7B:
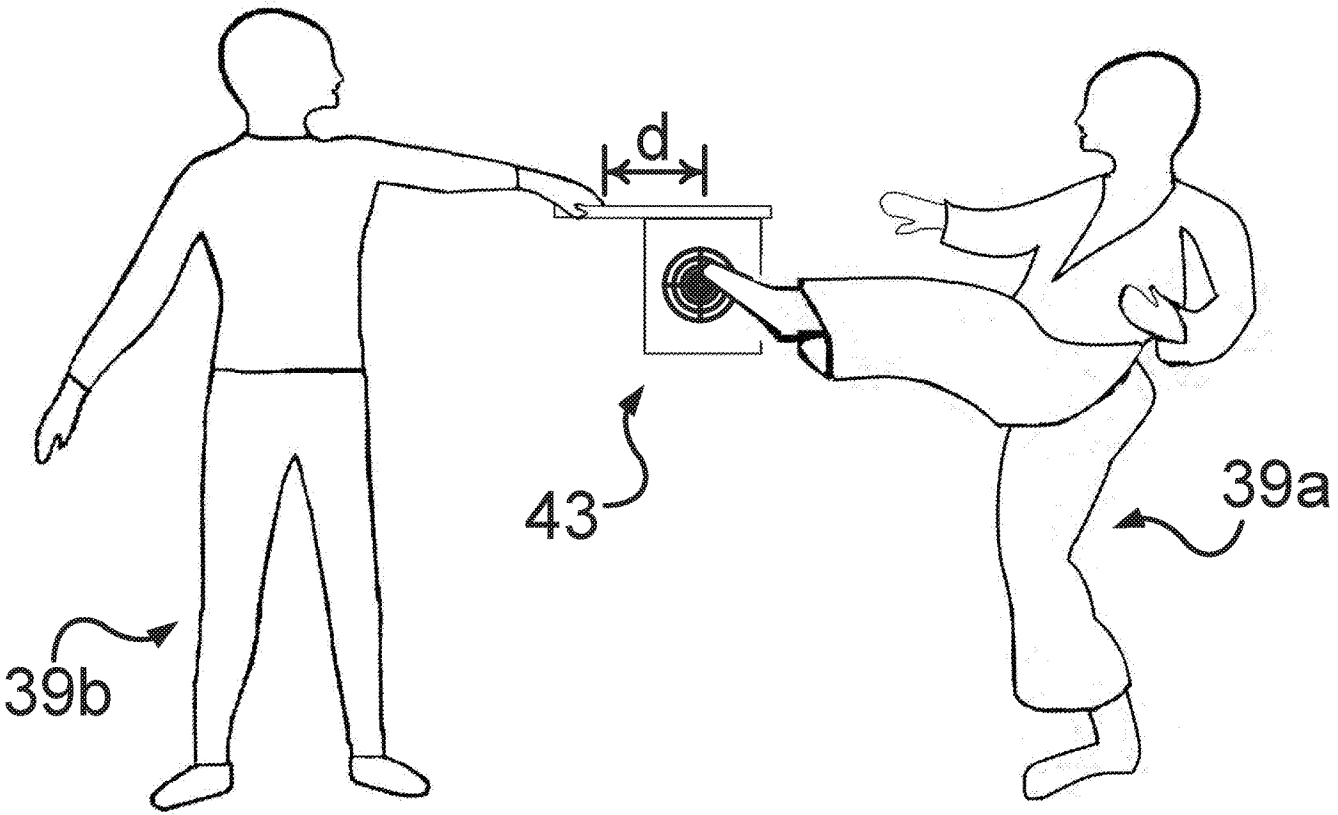
FIG. 7*b* is an illustration of an exemplary use of the striking target apparatus of FIG. 1 with a user kicking the flag with a foot.

With reference to FIGS. 1 and 3, striking target apparatus 43 includes a handle assembly 60 to which flag striking material 22 is secured. Handle assembly 60 includes an inner tube 24 and a cushion 27. Tube 24 may be made from any stiff material such plastic, or other equally stiff but light material. One suitable material from which inner tube 24 may be made is polyvinyl chloride ("PVC"). Tube 24 may be of any desired dimension in both diameter and length such that the flag striking material 22 may be supported in any desired orientation, such as vertical, horizontal, etc., so that it can be struck by a user 39*a* using a hand (see, e.g., FIG. 7*a*), a foot (see, e.g., FIG. 7*b*), an elbow, a knee, an arm, or other body part, as well as be used as a blocking and/or a striking apparatus (see, e.g., FIG. 7*c*). Additionally, tube 24 is designed to allow a trainer 39*b* to hold striking target apparatus 43 by handle assembly 60 a sufficient distance "d" from the focal point(s) of the flag striking material 22, thereby further reducing the chances of the trainer 39*b* being struck when the user 39*a* strikes, or attempts to strike the focal point(s) of the flag striking material 22. The length of tube 24 can be any length that allows the striking target apparatus 43 to be held in the desired position by a person (e.g., trainer 39*b*) or by a stand (as described in more detail below). Tube 24 may be from about 12 inches to about 36 inches long (in embodiments about 18 inches), and have a diameter of from about 0.5 inches to about 3 inches (in embodiments about 0.75 inches).

Tube 24 has a longitudinally-extending slit 25 defined therein that is slightly longer than edge 22*a* of flag striking material 22. As such, slit 25 is configured to receive flag striking material 22 therein. The width of slit 25 defined in tube 24 is slightly larger than the thickness of the flag striking material 22 such that the flag striking material 22 can be slidably received in slit 25 (in a proximal direction). Tape 26 may be installed on opposing end portions of slit 25, thereby preventing flag striking material 22 from sliding distally out of slit 25 in tube 24.

Restraints

Striking target apparatus 43 includes one or more restraints (e.g., a first restraint, a second restraint, etc.), for example, rivets 23, to prevent flag striking material 22 from moving laterally out of slit 25 in tube 24. In embodiments, any suitable restraint may be used, for example, one or more rivets, one or more braces, or one or more strip. In embodiments, a plastic strip 31 (FIG. 1) replaces or is used in conjunction with rivets 23 and is secured along and adjacent to lateral edge 22*a* of flag striking material 22. Rivets 23 may include two parts that when locked together are positioned through and on opposite sides of the pre-punched holes 30 in the flag striking material 22.

The forces applied on flag striking material 22 during use are such that those forces would tend to pull the flag striking material 22 laterally (i.e., horizontally) out of slit 25. However, the width of slit 25 prevents rivets 23 (or other restraint) from being pulled laterally through slit 25 (i.e., the restraints are wider than the width of slit 25 and cannot pass through slit 25). A tether, for example, tape 26 may be applied across a distal end portion of slit 25 and, in embodiments, wrapped around a distal end portion of tube 24 to prevent distal movement of the flag striking material 22 out of slit 25. It is further contemplated that a cap or plug (not shown) may be inserted into the distal end of tube 24 to prevent distal movement of the flag striking material 22 out of slit 25. Tape 26 may also be applied across a proximal portion of slit 25 and, in embodiments, wrapped around tube 24 to prevent proximal edge 22*d* of flag striking material 22 from contacting the distal end of slit 25, thereby reducing the chances of damaging edge 22*d*.

Figure 4A:
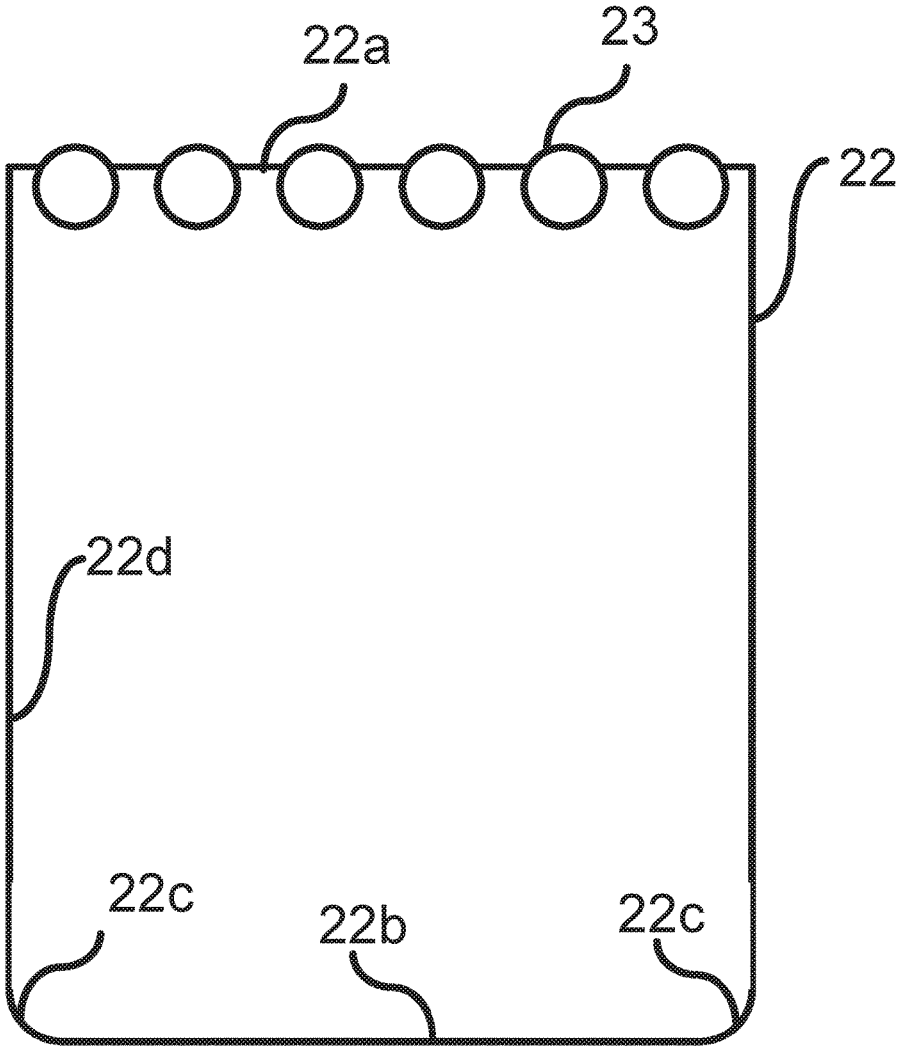
FIG. 4*a* is a side view of the striking portion having fasteners secured thereto.
Figure 4B:
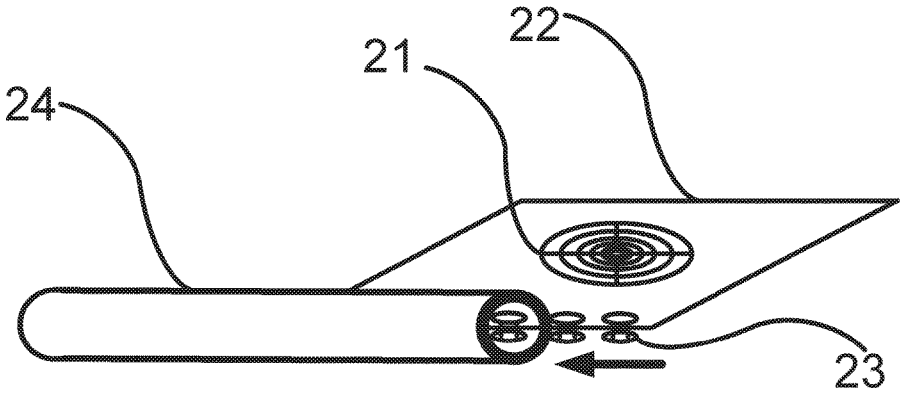
FIG. 4*b* is a top, perspective view of the striking target apparatus of FIG. 1 illustrating an insertion of the striking portion into the inner tube of the handle assembly.
Figure 4C:
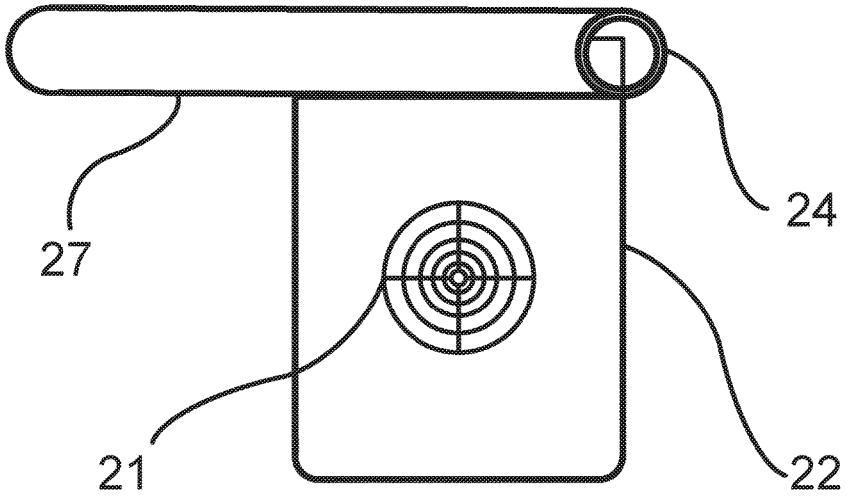
FIG. 4*c* is a side, perspective view of the striking target apparatus of FIG. 1 in an assembled state.
Figure 4D:
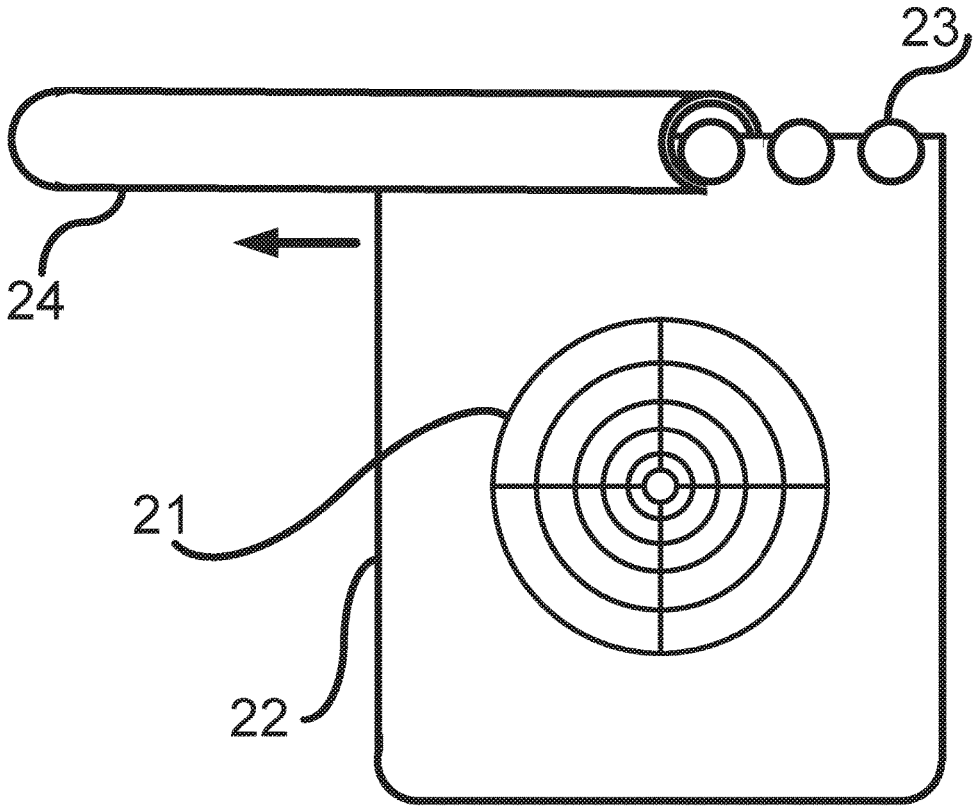
FIG. 4*d* is a side, perspective view of the striking target apparatus of FIG. 1 illustrating insertion of the striking portion into the inner tube of the handle assembly with the fasteners positioned within a central passageway of the inner tube.

In assembly, flag striking material 22 is inserted into tube 24 via slit 25 as depicted in FIGS. 4*b*, 4*d*. Rivets 23 are inserted within respective holes 30 defined along lateral edge 22*a* of flag striking material 22. Rivets 23 (or, in embodiments, strips 31) are locked together by means of a barb/lip to prevent removal from respective holes 30. As mentioned above, the restraints are large enough as to not be able to pass through slit 25, but small enough to fit inside inner passageway 24*a* of tube 24 as flag striking material 22 is slid longitudinally along slit 25. Flag striking material 22 is slid into tube 24 until edge 22*d* approximates the proximal end of slit 25. In embodiments, edge 22*d* is positioned about 1 inch from the proximal end of slit 25, leaving room for tape 26 to be applied across slit 25 between edge 22*d* and the proximal end of slit 25.

Cushion

In embodiments, handle assembly 60 of striking target apparatus 43 further includes a cushion 27 fabricated from a soft material configured to cover tube 24 to protect user 39*a* from injury when handle assembly 60 of striking target apparatus 43 is inadvertently or intentionally struck, or when handle assembly 60 of striking target apparatus 43 is used as a striking instrument. Cushion 27 is made from an energy absorbing material designed to reduce injury when struck. It is contemplated that cushion 27 may be fabricated from any suitable durable, flexible, and somewhat soft material. In embodiments, cushion 27 is fabricated from a material such as foam, rubber or polystyrene. Cushion 27 may be, for example, rubber self-seal pipe insulation. The first 2 inches of the "peal and seal" seam may be peeled back. Cushion 27 may be the same length as tube 24, so that upon assembly, the ends of cushion 27 are aligned with the ends of tube 24 and so that the seam is flat and even and does not extend over either end of tube 24 and the pipe is not showing. Cushion 27 may be tubular as shown or may have any desired profile, such as an ergonomically designed profile to facilitate grasping of the handle assembly, for example, by a trainer 39*b*. Cushion 27 defines a longitudinally-extending slit 28 therein.

Upon sliding cushion 27 onto the tube 24, slit 28 defined in cushion 27 is aligned with slit 25 defined in tube 24 and is secured to the flag striking material 22 to reduce slippage of cushion 27 relative to tube 24 and/or flag striking material 22. The slit 28 defined in cushion 27 may be closed, for example, by means of glue or tape. In embodiments, cushion 27 may have self-sealing glue pre-applied to the slit 28. By means of peeling back a protective plastic that covers the self-sealing glue, the glue is exposed to seal the slit 28 and hold cushion 27 to tube 24, further increasing the durability of cushion 27. The glue on slit 28 also adheres to flag striking material 22 preventing flag striking material 22 from sliding back and forth in slit 25.

Assembly

The assembly of the device is as follows. Preprinted sticker including indicia 21 is applied to the center of one or both sides of flag striking material 22 as a focal point. The orientation of the wording and logo art is such that the bottom is toward the edges 22*b* of flag striking material 22. Retainers are applied to flag striking material 22. For example, several barbed rivets 23 (twelve indicated here, made of plastic, nylon or other similar material that interlock preventing removal) are installed in holes 30 (the number of holes and rivets can vary based on the material used for the flag striking material 22). In embodiments, a plastic interlocking strip 31 can also be used alone, or in conjunction with rivets 23. After all rivets 23 are installed in holes 30 of flag striking material 22, flag striking material 22 it is slid longitudinally and in a proximal direction into slit 25 of tube 24. Given that the width of slit 25 is smaller than the width of rivets 23, and larger than the thickness of the flag striking material 22, flag striking material 22 is maintained within slit 25 of tube 24 without being able to be pulled out when waved, struck by a hand, finger, elbow, fist, foot, or other body parts and/or objects. Once flag striking material 22 is positioned within slit 25, tape 26 is applied to a distal end portion of tube 24 distal of flag striking material 22 and to a portion of tube 24 adjacent the proximal end of slit 25 proximal of edge 22*d* of flag striking material 22.

Slit 28 of cushion 27 is aligned with slit 25 of tube 24 and then cushion 27 is slid longitudinally onto tube 24 until flag striking material 22 is received within slit 28 of cushion 27. The glue or adhesive on slit 28 of cushion 27 is then used to join the cushion 27 to tube 24 and to the flag striking material 22 to prevent the flag striking material 22 from sliding out of the slits 25, 28 during use. The self-adhesive of cushion 27 provides sufficient stability to flag striking material 22 as there is little to no force placed on the flag striking material 22 in a longitudinal direction during normal use.

When flag striking material 22 is struck, a majority of the force is directed perpendicularly away from a longitudinal axis defined by handle assembly 60. This outward force tends to pull flag striking material 22 laterally out of slit 25, but flag striking material is prevented from laterally exiting slit 25 due to rivets 23. The number of rivets 23 is chosen to support the flag striking material 22 and prevent tearing of the flag striking material 22.

Example Manufacturing Technique

Indicia 21 may be provided on a sticker with, for example, a logo and a bull's-eye print 44. A sticker containing indicia 21 may be is applied to one or, in embodiments, both sides of flag striking material 22 to provide indicia on one or both sides of flag striking material 22. The indicia 21 may be applied to the center of flag striking material 22 offset (e.g., by about ½ inch), toward the edge 22*b* of flag striking material 22 (away from the holes 30) to account for the portion of the flag striking material 22 that is inside tube 24 and cushion 27 as to be centered on the visible portion of the flag after assembly.

In Use

The general use of the striking target apparatus 43 includes striking flag striking material 22 with a part of the body or striking the body with the cushion 27 to train the user in focusing their energy to a specific point on the target as well as using the apparatus 43 for blocking strikes from others when using the apparatus 43 as a club. As mentioned above, flag striking material 22 is fabricated from a material designed to emit a noticeable crack, thwack, or smack sound when struck so as to give the student a positive audible feedback and reinforcement in the contact and some indication of the energy transferred to the striking target apparatus 43 (i.e., sound volume increases with intensity). The type and quality of sound is dependent on the material chosen.

Figure 5B:
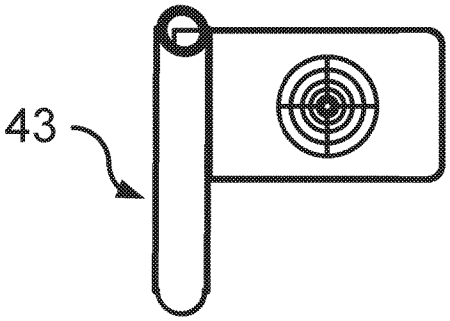
FIGS. 5*a*-5*d* illustrate the striking target apparatus in several planes as to describe its use in various forms related to the types of motions used in training.
Figure 5D:
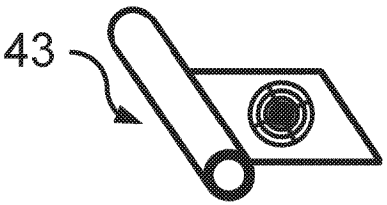
Figure 5A:
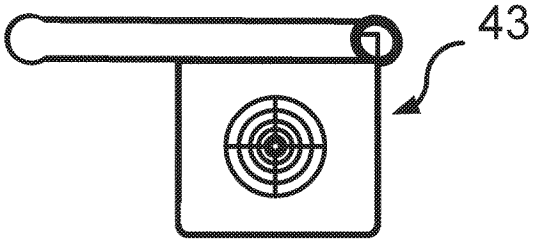
Figure 5C:
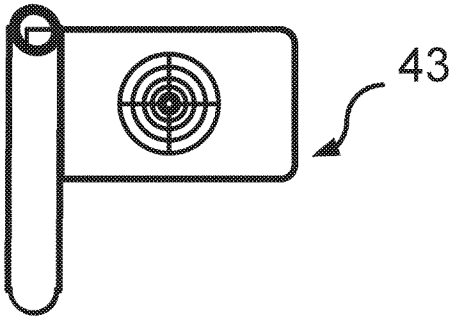
Figure 7C:
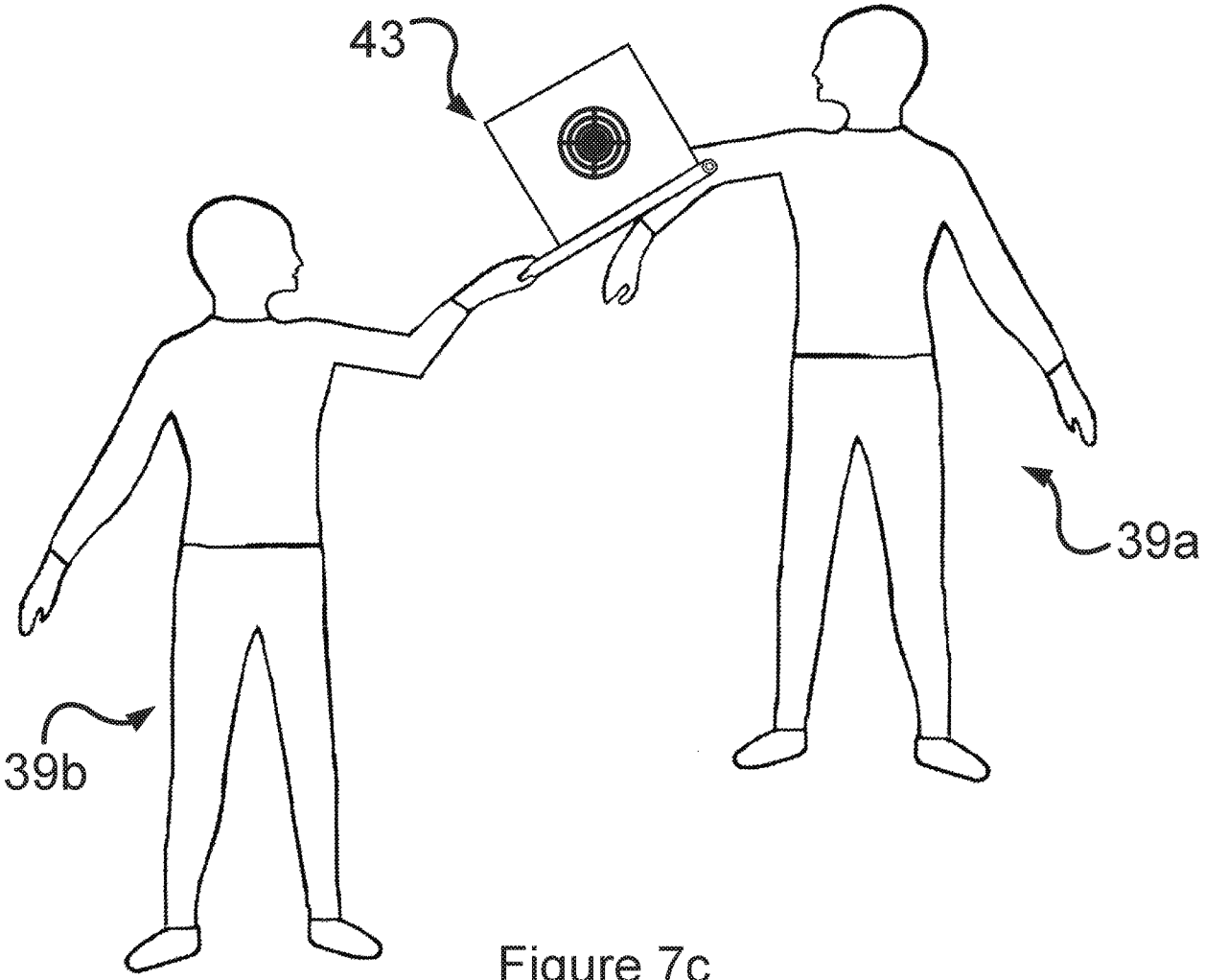
FIG. 7*c* is an illustration of an exemplary use of the striking target apparatus of FIG. 1 with a user striking another user with the striking target apparatus of FIG. 1 (or a user blocking the strike from another user)

When striking target apparatus 43 is used as a striking device as in FIG. 7*c*, the orientation of flag striking material 22 can be vertical, horizontal, or any other angle or plane on the X, Y, or Z axis as demonstrated in FIGS. 5*a*-5*d*. The material used for flag striking material 22 should be stiff enough to keep flag striking material 22 erect at the desired angle. Examples of desired placements include (but not limited to) hanging, horizontal, and vertical as depicted in FIGS. 5*a*-5*d*. In the hanging position as shown in FIG. 5*a*, the striking target apparatus 43 is most suitable for punching, thrust kicking, or roundhouse kicking (when the leading edge is toward the user). In the vertical plane as shown in FIGS. 5*b* and 5*c*, flag striking material 22 can be thrust kicked (high or low), punched, or roundhouse kicked (when leading edge it presented toward user). In the case of presentation on the horizontal plane as shown in FIG. 5*d*, flag striking material 22 can be kicked or chopped. In the examples above when the action described is a punch or kick, it implies any forward moving action toward the flag striking material 22 and could include other action like elbow strike, knee strike, head butt, or other forward moving action. In the case as described as roundhouse kick, it implies any circular type action whereas the body is rotated on its axis. In the case of a chop, it implies any vertical style action either up or down.

Additionally, the striking target apparatus 43 can be used as a blocking training aid as shown in FIG. 7*c*. In this scenario, the holder 39*b* swings the apparatus 43 in a motion to strike the user 39*a* with the handle assembly 60. The user 39*a* then blocks the strike attempt with their body parts as desired. This can be used with striking and blocking as combination sequences allowing for more complicated workout scenarios. The blocking training can be used to learn the methods of transferring what would be striking blow energy into deflected energy to drive the blow away from the body instead of trying to absorb the energy.

The striking target apparatus 43 is light and easy to hold. The teacher, trainer, aid, helper, parent or even another student can hold the striking target apparatus 43 in any desired position allowing the user to attempt to strike the target as instructed. Cushion 27 is comfortable to hold and by use of the flexible flag striking material 22 little to no force is transferred from flag striking material 22 to the holder. In the event that the user strikes the handle assembly 60, the cushion 27 of the handle assembly 60 helps to absorb the impact both for the striker 39*a* and the flag holder 39*b*. The size of the handle assembly 60 and flag striking material 22 are designed such that striking the handle assembly 60 is minimized even for beginners.

Stand Assembly

Figure 6A:
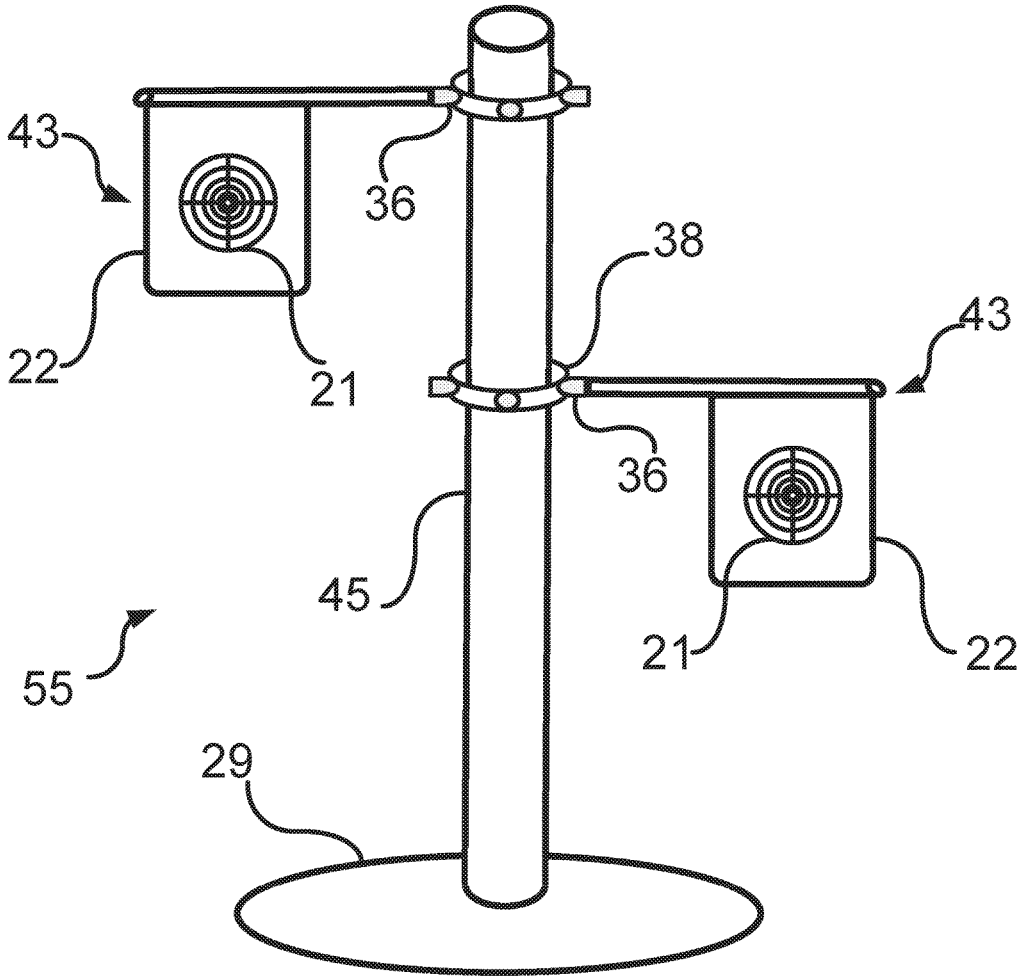
FIG. 6*a* is a perspective view of an embodiment of a stand assembly using locking collars to allow several of the striking target apparatus of FIG. 1 to be mounted at various angles and planes for use in training with multiple users, or a single user, in multiple strikes.
Figure 6B:
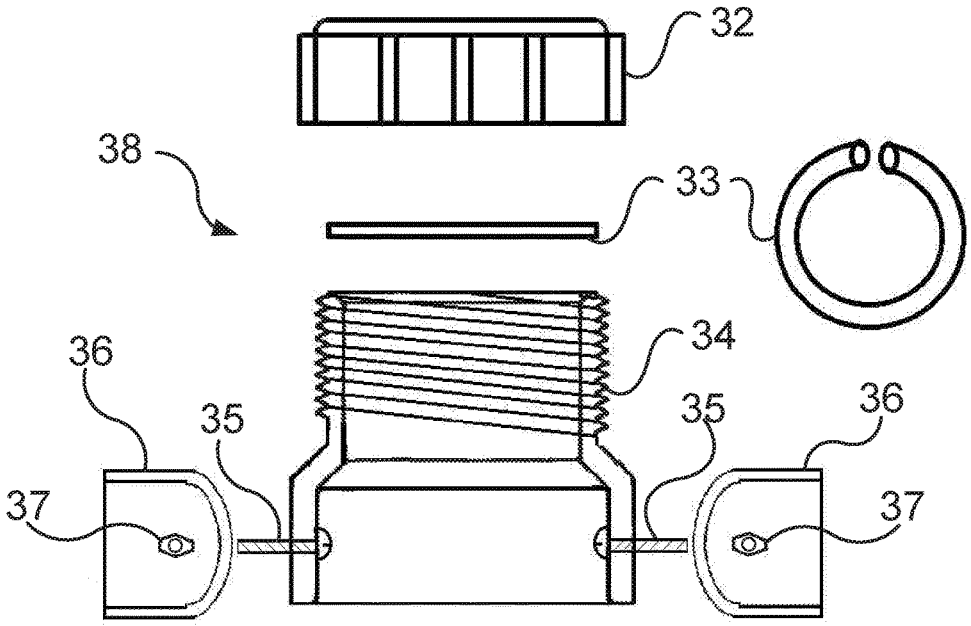
FIG. 6*b* is a front view, with parts separated, of an embodiment of a coupling member for mounting the striking target apparatus to the stand assembly of FIG. 6*a* at various planes.
Figure 6C:
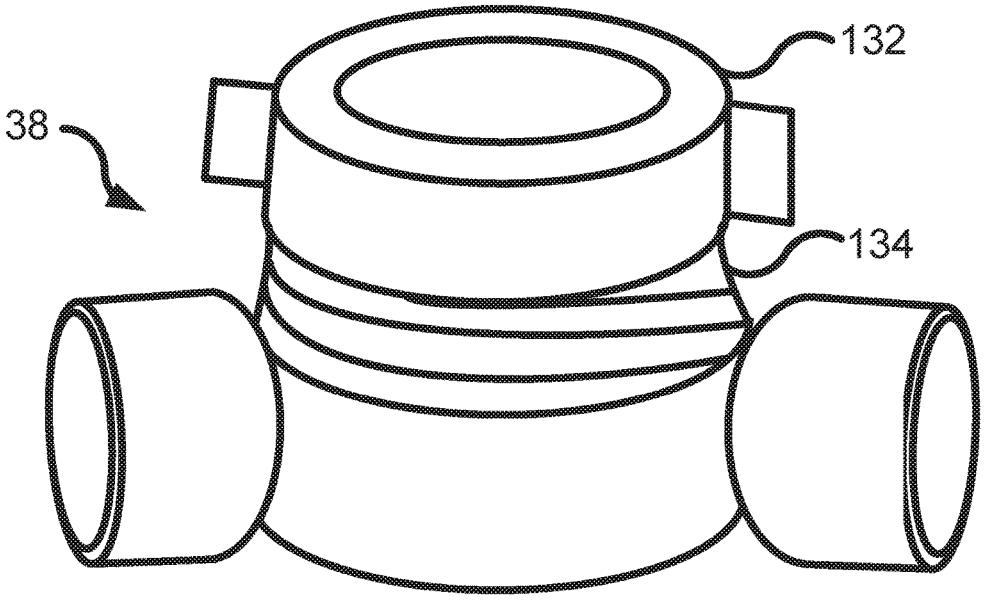
FIG. 6*c* is a front, perspective view of the coupling member of FIG. 6*b;*

In one embodiment, as shown in FIGS. 6*a*-6*c*, the striking target apparatus 43 in its entirety, or only the flag striking material 22 of the striking target apparatus 43, may be mounted to a mechanical device, for example, a stand assembly 55. The stand assembly 55 includes a base 29, a vertical pole 45, and locking rings 38 having striking target apparatus 43 mounted thereto. In embodiments, a tubular member may be attached to locking ring 38 and configured for attachment of flag striking material 22. In some embodiments, vertical pole 45 may be PVC pipe with a diameter of from about 1 to about 6 inches, in embodiments, about 1.25 inches.

Locking ring 38 includes a collar or cap 32 with female threads (not shown) defined therein, a washer/bushing 33, and another collar 34 with male threads configured for threading engagement with the female threads of cap 32. With locking ring 38 disposed on pole 45, the two collars 32, 34 are engaged and the washer/bushing 33 is compressed until sufficient pressure is applied to pole 45 to firmly hold locking ring 38 in place on pole 45. For example, locking ring 38 may be in the form of a 1.5 inch trap adapter, wherein bushing 33 may be a 0.25 inch flexible plastic tubing disposed between collars 32, 34. The compression of bushing 33 creates enough pressure to hold locking ring 38 in any position on vertical pipe 45.

Locking collar 38 includes couplers 36 disposed around the perimeter of collar 34 that hold striking target apparatus 43 at various angles around pole 45. In embodiments, couplers 36 may be ½ inch PVC caps. Couplers 36 each define a threaded bore 37 therethrough configured for receipt of a fastener 35 to fix couplers 36 to a base of collar 34. Couplers 36 are configured to capture a proximal end of handle assembly 60 of striking target apparatus 43.

It is contemplated that a plurality of collars 38 may be coupled to pole 45 of stand assembly 40, with each collar 38 having a plurality of couplers 36, allowing for several striking target apparatus 43 to be simultaneously coupled to pole 45 at various angles.

In embodiments, couplers 36 may be in the form of ½ inch female/female couplers allowing two striking target apparatus 43 to be joined together to allow multiple flags to be easily presented by a single user (teacher, trainer, aid, or parent). Couplers 36 may be in the form of a T-shaped coupler configured for receipt of three striking target apparatus 43.

Figure 6D:
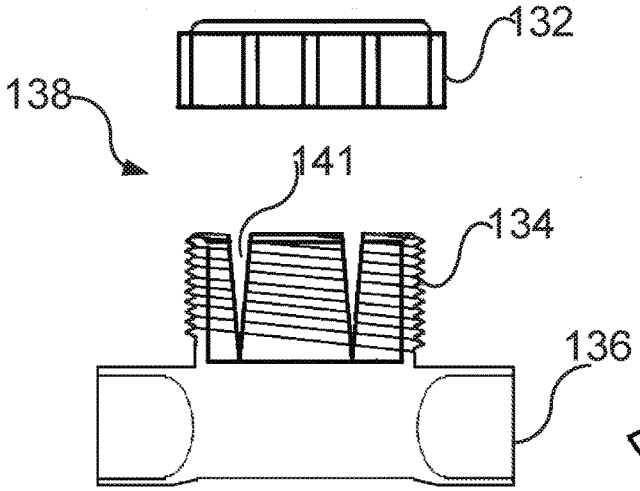
FIG. 6*d* is a front view, with parts separated, of another embodiment of a coupling member for mounting the striking target apparatus to the stand assembly of FIG. 6*a* at various planes.
Figure 6E:
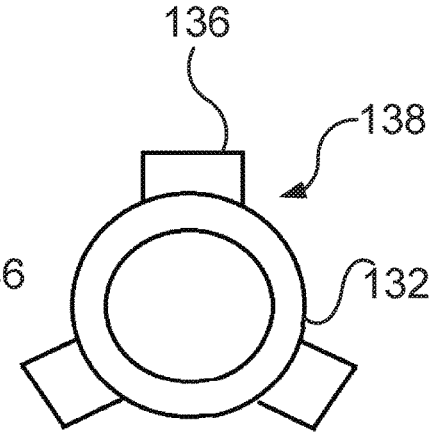
FIG. 6*e* is a top view of the coupling member of FIG. 6*d;*
Figure 6F:
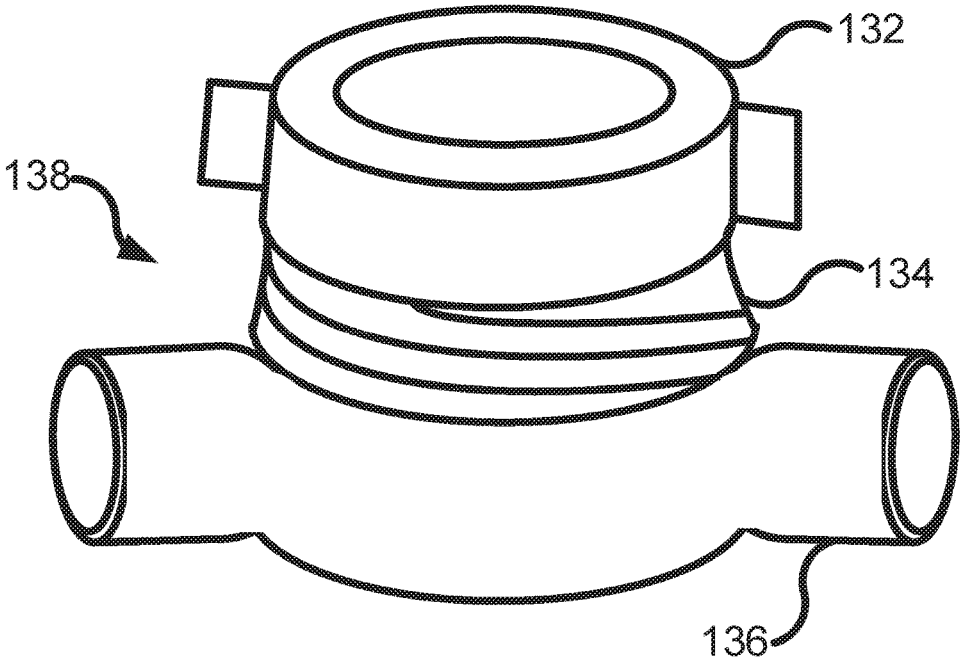
FIG. 6*f* is a front, perspective view of the coupling member of FIG. 6*d;*

With reference to FIGS. 6*d*-6*f*, another embodiment of a locking collar 138, similar to locking collar 38, is provided to couple striking target apparatus 43 to stand assembly 55. Locking collar 138 is different from locking collar 38 in that locking collar 138 includes couplers 136 that are monolithically formed with, or integrally connected to, a base collar 134 of locking collar 138. The couplers 136 may be fabricated from ½ inch PVC. In addition, base collar 134 has slotted groves 141 defined therein. In this way, as a top collar 132 of locking collar 138 is threaded onto base collar 134, base collar 134 constricts making the inner diameter of base collar 134 approximate that of the outer diameter of pole 45. This constriction can be used to lock locking collar 138 in any position on vertical pole 45.

Figure 8:
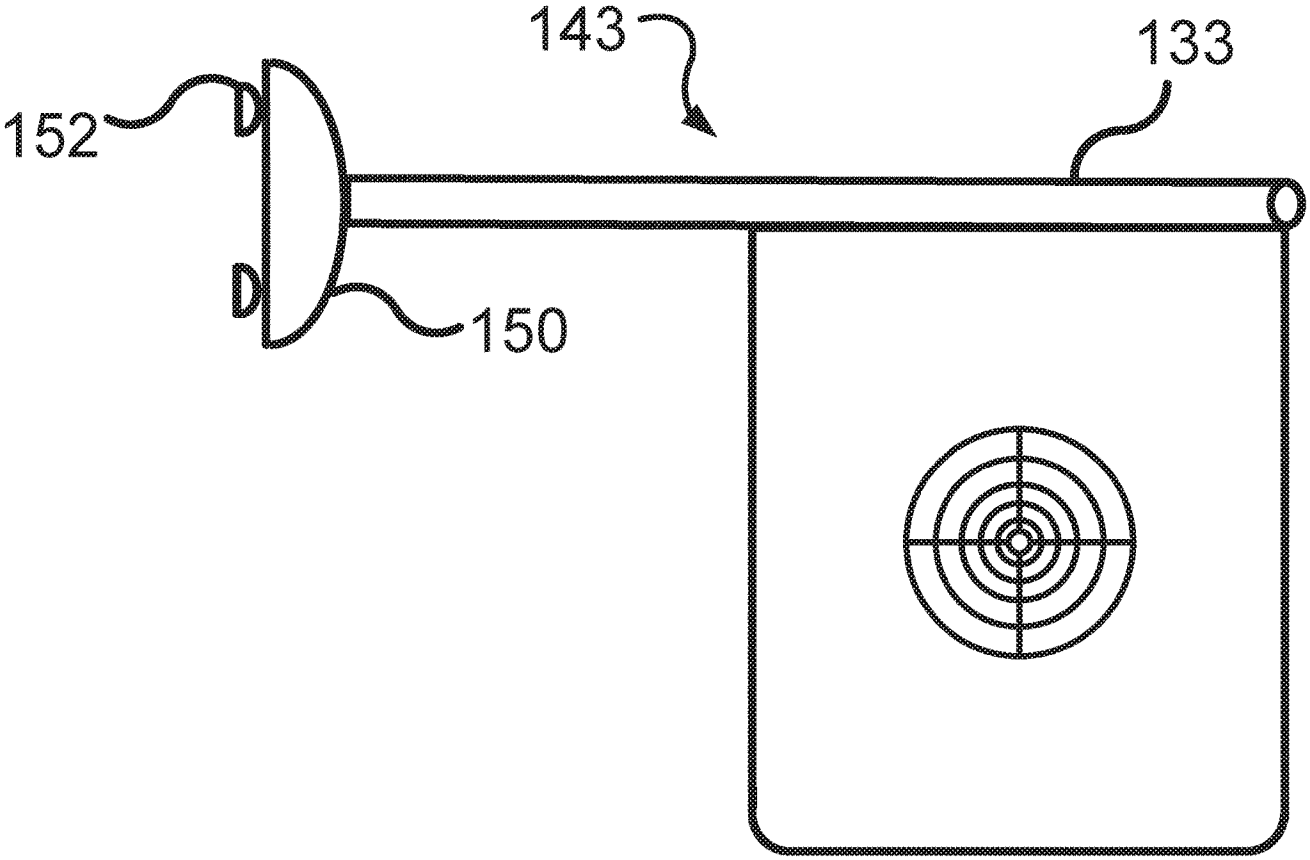
FIG. 8 is a side view of another embodiment of a striking target apparatus including suction cups for mounting the striking target apparatus to a wall or other smooth surface.

With reference to FIG. 8, another embodiment of a striking target apparatus 143 is shown, similar to striking target apparatus 43 described above. Striking target apparatus 143 is different from striking target apparatus 43 described above in that striking target apparatus 143 includes a coupler 150 coupled to a proximal end of handle assembly 133. It is contemplated that coupler 150 may have a suction cup or a plurality of suction cups 152 to secure striking target apparatus 143 to any smooth surface such as a window, mirror, or wall. By means of additional ½ inch couplers (inline, 90 degree, T coupler, etc . . . ) and additional ½ inch PVC pipe, the flag handle can be extended or positioned at an infinite number of angles. It is further contemplated that in lieu of suction cup(s), the coupler 150 may be a bracket that can be secured to a wall or other surface via fasteners (e.g., screws), or may be two sided tape to adhere striking target apparatus 143 to a wall or other surface.

The effective use of this apparatus is exceptionally advantageous when used with children, allowing them to strike the apparatus without the fear of injuring themselves while allowing them to put significant attention to the goal of focusing their strike to the a location on or center of the target. In addition, the indicia provided on the flag may include artwork, text, and/or logos with sections or bull's-eye design with cross hairs to provide quadrants of area to allow focused strikes as indicated by the instructor or trainer.

Kits

It is further contemplated that kits containing parts necessary to assemble one or more striking targets in accordance with the present disclosure may be presented in a common package. In embodiments, the kit further includes components for a stand to support the one or more striking targets.

Figure 9:
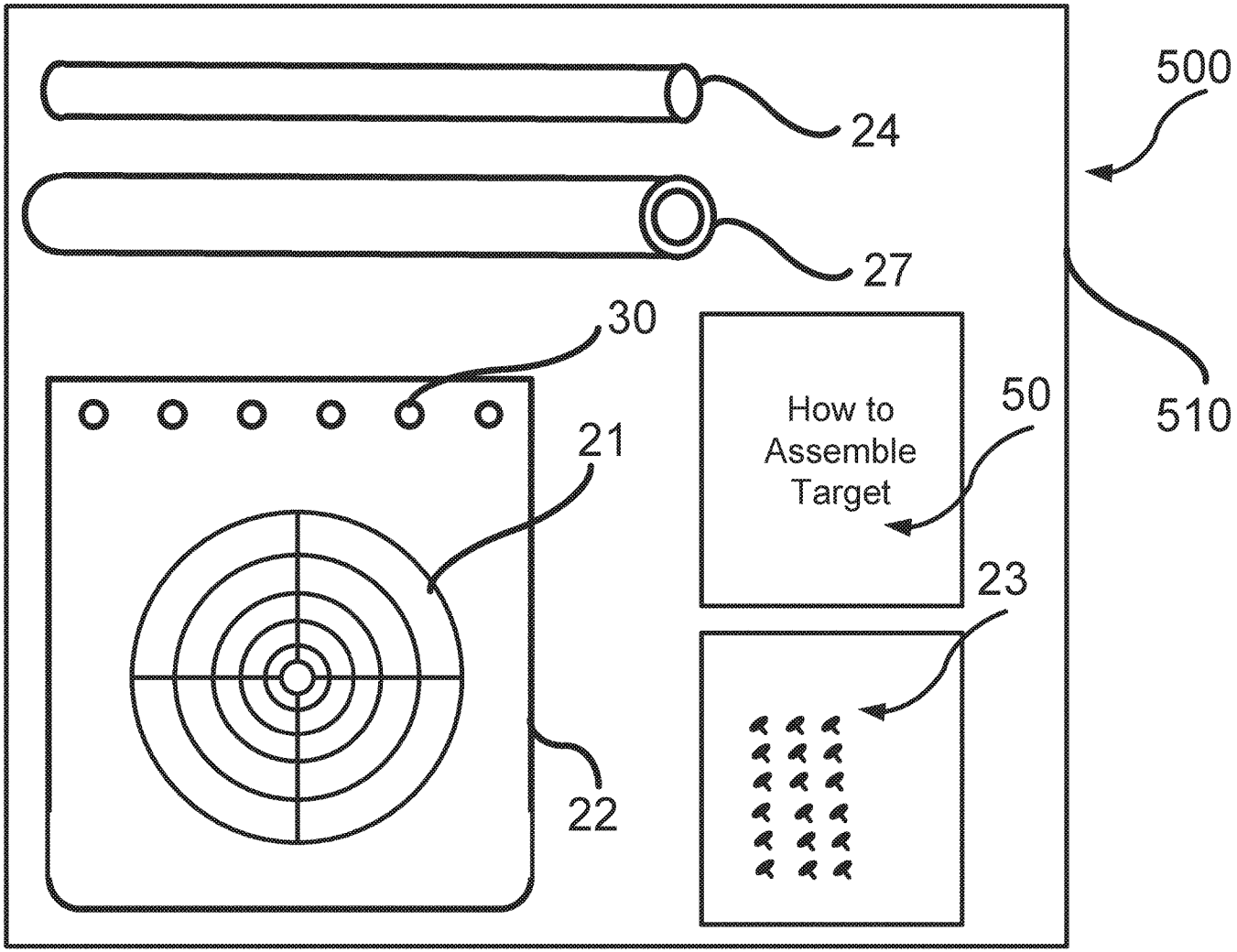
FIG. 9 shows a kit containing parts necessary for a consumer to assemble a striking target apparatus in accordance with an embodiment of the present disclosure.

In an exemplary embodiment shown in FIG. 9, kit 500 has a package 510 that contains a tube 24, a cushion 27, a pre-drilled flag 22, a restraint (such as, for example, a collection rivets 23 in the exemplary embodiment shown), and instructions 50 directing a consumer how to assemble the parts, for example as described above.

While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of presently disclosed embodiments. Thus the scope of the embodiments should be determined by the appended claims and their legal equivalents, rather than by the examples given.

The invention claimed is:

1. A striking target apparatus, comprising:
- a handle assembly including:
  - an inner tube including:
    - a hand-held proximal portion; and
    - a distal portion having a longitudinally-extending slit; and
  - an outer cushion disposed about the inner tube, the outer cushion having a longitudinally-extending slit aligned with the slit of the inner tube;
- a striking portion secured within the slit of the inner tube, the striking portion including a target substantially centrally positioned thereon; and
- a first restraint coupled to the handle assembly and disposed distally of a distal edge of the striking portion to prevent distal movement of the striking portion relative to the handle assembly.

2. The striking target apparatus according to claim 1, wherein the striking portion is a sheet of plastic.

3. The striking target apparatus according to claim 2, wherein the sheet of plastic includes polyethylene terephthalate.

4. The striking target apparatus according to claim 1, further comprising a second restraint attached to a lateral side of the striking portion, the second restraint having a width greater than a width of the slit of the inner tube thereby inhibiting movement of the striking portion out of the slit of the inner tube.

5. The striking target apparatus according to claim 4, wherein the second restraint includes a plurality of rivets attached along the lateral side of the striking portion.

6. The striking target apparatus according to claim 1, wherein the striking portion is fabricated from a material configured to emit a sound when struck.

7. The striking target apparatus according to claim 1, wherein the outer cushion is fabricated from foam.

8. The striking target apparatus according to claim 1, further comprising at least one suction cup for mounting the handle assembly to a smooth surface.

9. A kit comprising:
- a package containing therein:
  - an inner tube including:
    - a hand-held proximal portion; and
    - a distal portion having a longitudinally-extending slit;
  - an outer cushion configured to be disposed circumferentially around the inner tube;

a striking flag dimensioned and configured to be slid into the slit of the inner tube;

a first restraint configured to be coupled to the handle assembly and disposed distally of a distal edge of the striking portion to prevent distal movement of the striking portion relative to the handle assembly; and a second restraint configured to be secured adjacent a lateral edge of the striking flag and dimensioned, once secured to the striking flag, to fit within the inner tube and to be restrained from passing through the slit in the inner tube.

10. The kit according to claim 9, further comprising a sticker including indicia for application to the striking flag.

11. A martial arts training system, comprising:

the striking target apparatus according to claim 1; and a stand assembly configured to support the striking target apparatus.

12. The martial arts training system according to claim 11, wherein the stand assembly includes a base, a vertical pole, and a locking ring having the striking target apparatus mounted thereto.

13. The martial arts training system according to claim 12, wherein the locking ring includes:

a first collar having female threads defined therein;

a second collar having male threads configured for threading engagement with the female threads of the first collar; and a washer configured to be compressed between the first and second collars upon threading engagement of the male threads of the second collar with the female threads of the first collar.

14. The martial arts training system according to claim 13, wherein the first collar includes a coupler for retaining the striking target apparatus.

15. The striking target apparatus according to claim 5, wherein at least one rivet of the plurality of rivets has opposing ends enclosed within the inner tube.

16. The striking target apparatus according to claim 1, wherein the distal edge of the striking portion is disposed proximally of a distal end of the distal portion of the inner tube.

17. The kit according to claim 9, wherein the second restraint has a pair of opposing ends disposed within the inner tube when the lateral edge of the striking flag is received within the inner tube.

18. A striking target apparatus, comprising:

a handle assembly including:

an inner tube including:

a hand-held proximal portion; and a distal portion having a longitudinally-extending slit; and an outer cushion disposed about the inner tube, the outer cushion having a longitudinally-extending slit aligned with the slit of the inner tube, the outer cushion including an adhesive on at least one side of the slit in the outer cushion;

a striking portion secured within the slit of the inner tube; and a first restraint coupled to the handle assembly and disposed distally of a distal edge of the striking portion to prevent distal movement of the striking portion relative to the handle assembly.

* * * * *